US005834696A

United States Patent [19]

Kurosawa et al.

[11] Patent Number: 5,834,696

[45] Date of Patent: Nov. 10, 1998

[54] TERMINAL FOR COUPLING WIRINGS

[75] Inventors: Akira Kurosawa; Yoshiyasu Negishi, both of Atsugi, Japan

[73] Assignee: Unisia Jecs Corporation, Kanagawa-ken, Japan

[21] Appl. No.: 803,912

[22] Filed: Feb. 21, 1997

[30] Foreign Application Priority Data

Feb. 22, 1996 [JP] Japan ..... 8-059960

[51] Int. Cl.[6] ..... H01R 13/28

[52] U.S. Cl. ..... 174/84 C; 174/845; 174/86; 174/87; 439/288

[58] Field of Search ..... 174/84 C, 845, 174/86, 87; 439/12, 13, 288, 883, 907

[56] References Cited

U.S. PATENT DOCUMENTS

| | | | |
|---|---|---|---|
| 2,626,168 | 1/1953 | Macy | 439/288 |
| 3,316,522 | 4/1967 | Demler | 439/288 |
| 3,322,886 | 5/1967 | Warshawsky | 439/13 |
| 4,357,070 | 11/1982 | Fukushima et al. | 439/288 |

*Primary Examiner*—Bot L. Ledynh
*Assistant Examiner*—Marc. D. Machtinger
*Attorney, Agent, or Firm*—McDermott, Will & Emery

[57] ABSTRACT

A terminal for coupling wirings of the present invention is simply constructed, features enhance coupling/assembling operability, and needs decreased space. A terminal body (21) is constituted by a wiring connection portion (22) and an overlapping portion (21). an external wiring is fastened by caulking to the wiring connection portion (22) and is connected thereto. An engaging pawl (26) and an engaging piece (27) are formed on the overlapping portion (23) on both sides of the bolt insertion hole (25). The pair of terminal bodies (21) are turned relative to each other in the circumferential direction of the bolt insertion hold (25) in a state where the overlapping portions (23) are overlapped one upon the other on the back surface side thereof. Then, the engaging pawl (26) rides on the engaging piece (27) of the opposing terminal body, and the engaging pawl (26) and the engaging piece (27) come into engagement with each other. The terminal bodies (21) are coupled with each other in a state where the wiring connection portions (22) are overlapped one upon the other.

8 Claims, 7 Drawing Sheets

TERMINAL FOR COUPLING WIRINGS

TECHNICAL FIELD

The present invention relates to a terminal for coupling wirings which is preferably used for coupling the wirings consisting of, for example, two lead wires to each other, thereby fastening them together using a bolt or the like.

BACKGROUND ART

A conventional terminal for coupling wirings of this type can be represented by, for example, grounding terminals (No. 8100-0714, No. 8100-0715) manufactured by Sumitomo Densen Co., etc. This is used for attaching or grounding wirings of the grounding side of electronic parts mounted, for example, on an automobile to the body thereof by using a bolt or the like.

In such a conventional terminal for coupling the wirings, two terminal bodies to which are connected the grounding side wirings are coupled together by slipping a recessed engaging portion of one terminal body under the back surface side of a protruded engaging portion of the other terminal body, slipping another recessed engaging portion formed on the opposite side of a bolt insertion hole formed nearly in the central portion of the above one terminal body under the back surface side of another protruded engaging portion formed on the opposite side of a bolt insertion hole formed nearly in the central portion of the above other terminal body, and linearly moving the two terminal bodies relative to each other until the positions of the bolt insertion holes formed nearly in the central portions of the terminal bodies come into agreement with each other.

Then, a stopper (having a protruded shape) provided in the recessed engaging portion of the above one terminal body is brought into engagement with a corresponding stopper hole (having a recessed shape) provided in the protruded engaging portion of the above other terminal body, and a stopper hole (having a recessed shape) formed in another recessed engaging portion of the above one terminal body is brought into engagement with a corresponding stopper (having a protruded shape) provided in another protruded engaging portion of the above other terminal body, ea that the two terminals for coupling the wirings are held in an engaged state.

In the above-mentioned conventional terminal for coupling the wirings, however, the stoppers and the stopper holes must be brought into engagement together while bringing the recessed engaging portions provided in one terminal body into engagement with the protruded engaging portions of the other terminal body. In other words, the two terminal bodies must be linearly moved relative to each other along the same axis maintaining a relatively good precision while receiving resistive force of the wirings. Besides, the coupling operation is so complex that it is difficult to easily and reliably couple the two terminal bodies together within short periods of time.

In the above-mentioned conventional terminal for coupling the wirings, furthermore, when the two terminal bodies are coupled together, the wiring connection portions of the terminal bodies are located on both sides of the bolt insertion holes which are in agreement with each other. Therefore, an extra mounting space is required making it difficult to save space or to enhance the efficiency of assembling operation.

The present invention was accomplished in view of the abovementioned circumstances and its object is to provide a terminal for coupling the wirings, which makes it possible to couple the terminal bodies easily, correctly and reliably within short periods of time, to enhance the efficiency of the coupling operation, to save space, and to enhance the efficiency of the assembling operation.

DISCLOSURE OF THE INVENTION

The present invention therefore provides a terminal for coupling wirings comprising a pair of terminal bodies, each having a wiring connection portion on the side of the base end thereof and an overlapping portion with a bolt insertion hole on the side of an end thereof, and coupling means provided on the overlapping portions of the terminal bodies to hold the terminal bodies in a state of being coupled together;

wherein said coupling means includes an engaging pawl formed on the overlapping portion of the terminal body and is positioned on one side of the bolt insertion hole in the direction of diameter thereof, and an engaging piece formed on the overlapping portion of the terminal body in a resiliently deformable manner and is positioned on the other side of the bolt insertion hole in the direction of diameter thereof; and wherein the overlapping portions of the terminal bodies are overlapped one upon the other and are turned relative to each other in the circumferential direction of the bolt insertion hole, so that the engaging place engages with the engaging pawl of the opposing terminal body and that the terminal bodies are held in a state of being coupled together.

With such a constitution, when the overlapping portions of the terminal bodies are overlapped one upon the other on the sides of the back surfaces and are turned relative to each other in the circumferential direction of the bolt insertion holes, the engaging piece is resiliently deformed by the engaging pawl of the opposing terminal body, and the engaging pawls and the engaging pieces are engaged with each other. That is, the engaging pawls are engaged with the engaging pieces on one side and on the other side in the direction of the diameter in a state where the terminal bodies are turned relative to each other up to predetermined positions.

According to the present invention, therefore the engaging pawl reliably engages with the engaging piece of the opposing terminal body through a very simple operation of turning a pair of terminal bodies relative to each other, solving the problem in that the engaging/coupling operation is so complex that the pair of terminal bodies are not coupled together easily, correctly and reliably within short periods of timer that is inherent in the prior art. Thus, the efficiency of the coupling/assembling operation is greatly enhanced. With the terminal bodies being coupled together on the sides of the back surfaces, furthermore, the wiring connection portions are overlapped one upon the other, making it possible to decrease the width between the two, to decrease space, to easily lay out the terminal bodies at the predetermined mounting positions, and to enhance the efficiency of the mounting operation.

The engaging pieces can be so constituted as to be detachably brought into engagement with the engaging pawls.

This gives an advantage of reuse or reassembling compared with those in which the engaging pieces and the engaging pawls are not allowed to be separated from each other after they are once engaged together (such as those which are produced giving priority to low cost or reliable engagement).

Furthermore, the engaging pawls are protruded inwardly of the bolt insertion holes in the direction of diameter thereof, and the engaging piece is so constituted that the end thereof which is the free end extending nearly arcuately in the Circumferential direction of the bolt insertion hole comes into engagement with the engaging pawl of the opposing terminal body.

Then, upon turning the overlapping portions relative to each other in the circumferential direction of the bolt insertion holes, the engaging pawl is moved in the circumferential direction of the bolt insertion hole and is caused to ride on the engaging piece of the opposing terminal body from the end thereof. Thus, the engaging pawl is easily brought into engagement with the engaging piece of the opposing terminal body and, hence the terminal bodies can be coupled together through a further simplified coupling operation. Since the constitution is simple, furthermore, the coupling terminals can be easily press-molded without increasing the number of the production steps or the cost of production.

Moreover, both the engaging piece and the engaging pawl, or either the engaging piece or the engaging pawl may include a guide portion for guiding the engagement of the engaging pawl with the engaging piece.

When the overlapping portions are turned relative to each other and the engaging pawl comes into contact with the end of the engaging piece of the opposing terminal body, therefore, the engaging pawl is caused to easily ride on the engaging piece via the guide portion. Accordingly, the coupling operation becomes more easy and reliable.

Moreover, the engaging piece or both the engaging piece and the engaging pawl may include a hook portion for holding the engaging pawl and the engaging piece in a state of being hooked.

Accordingly, the engaging pawl can be reliably held in a state of being hooked to the hook portion of the opposing terminal body in a state where the terminal bodies are turned relative to each other up to predetermined positions This helps further enhance the fastening operation using bolt or the like.

BEST MODE FOR CARRYING OUT THE INVENTION

An embodiment of the present invention will now be described in detail with reference to the accompanying drawings.

Figure 1:
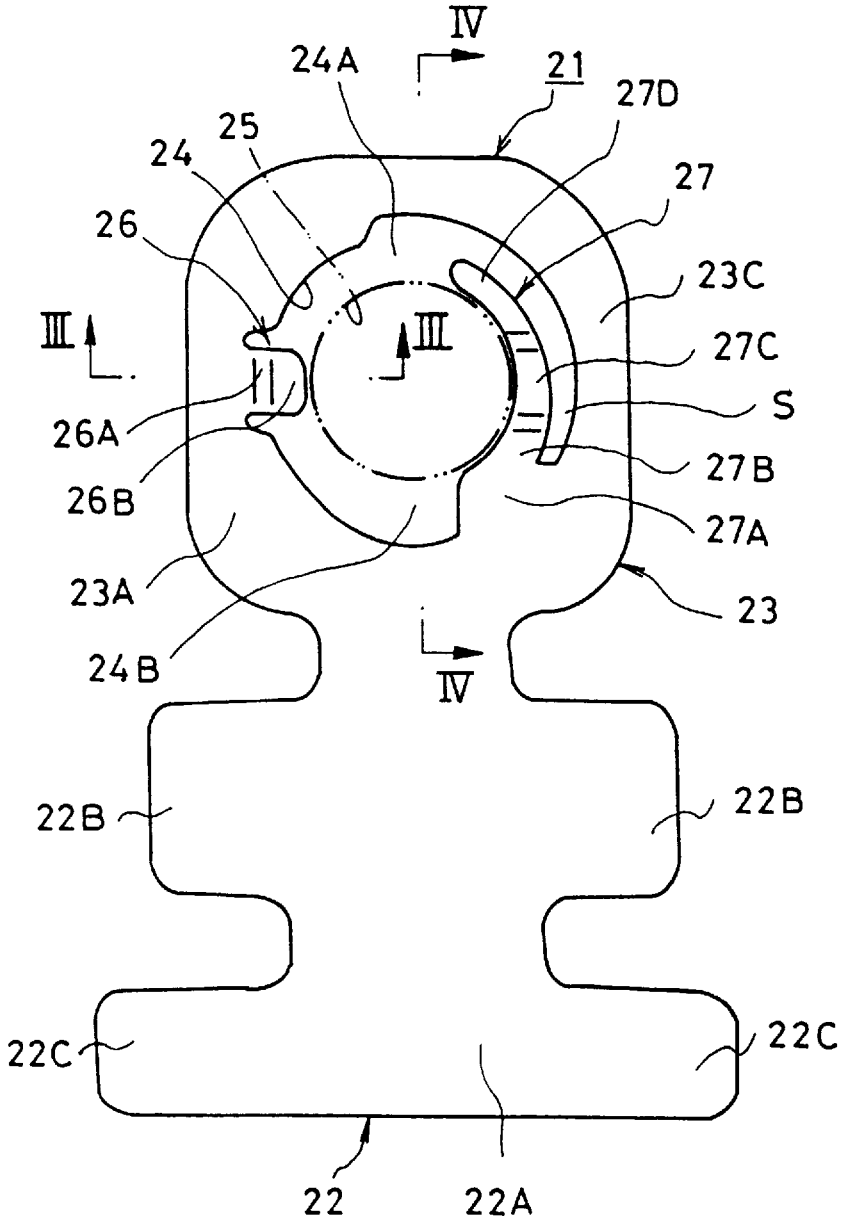
FIG. 1 is a front view illustrating a terminal body of a terminal for coupling tie Wrings according to the present invention.

In the drawings, reference numeral 21 denotes a terminal body constituting a terminal for coupling wirings according to the embodiment. Like that of the prior art the terminal body 21 is obtained by press-molding a thin metal plate having, for example, a thickness T (see FIG. 3) and has, on the base end side thereof, a wiring connection portion 22 forming a caulking seat portion 22A, and caulking portions 22B, 22B and 22C, 22C protruding toward the right and left therefrom, and has, on the end side thereof, an overlapping portion 23 that will be overlapped on a counterpart terminal body 21. The caulking portions 22B, 22C shown in FIG. 1 are those of prior to caulking a wiring 3 (see FIG. 5). Thereafter, the caulking portions 22B, 22C are previously formed nearly in a U-shape in cross section by press-molding or the like method with the caulking seat portion 22A being held therebetween so as to be protruded toward the front surface side of the terminal body 21 (caulking seat portion 22A). Thus, the wiring 3 arranged on the caulking seat portion 22A can be easily fastened by caulking from both sides.

Figure 3:
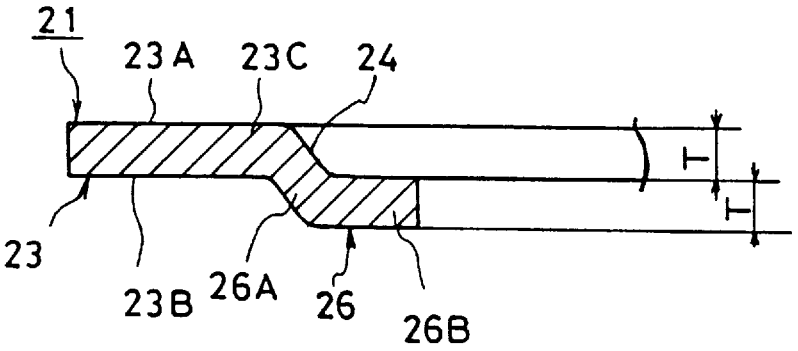
FIG. 3 is a sectional view illustrating an engaging pawl of the overlapping portion along the arrow III—III in FIG. 1.

Here, as shown in FIG. 3, the overlapping portion 23 is formed in the form of a thin plate having a front surface 23A and a back surface 23B. On the inner peripheral side 23C of the overlapping portion 23 is formed a hole 24 being punched by press-molding or the like as shown in FIG. 1. On the inner peripheral side 23C is further formed an engaging pawl 26 and an engaging piece 27 being protruded inwardly of the punched hole 24, and a bolt insertion hole 26 is constituted inside the punched hole 24 being located between the engaging pawl 26 and the engaging piece 27.

Inside the punched hole 24 is provided an engaging pawl disposing portion 24A at a positron near the end of a guide portion 27D of the engaging piece 27 that will be described later, so that the engaging pawl 26 of the opposing terminal body will, be disposed therein first when the terminal bodies 21 are coupled together. Besides, between the engaging pawl 26 and a support portion 27A of the engaging piece 27 that will be described later is provided an engaging piece disposing portion 24B where the engaging piece 27 of the opposing terminal body will be disposed first.

Reference numeral 26 denotes the engaging pawl formed on the terminal body 21 as coupling means. The engaging pawl 26 is located on one side of the bolt insertion hole 25 in the direction of diameter thereof and is formed nearly in an L-shape in cross section on the inner peripheral side 23C of the overlapping portion 23. As shown in FIG. 3, the engaging pawl 26 is constituted by a folded portion 26A which is folded to protrude from the inner peripheral side 23C toward the side of the back surface 23B of the overlapping portion 23 by an amount equal to the thickness T thereof, and a pawl portion 26B which protrudes from the end of the folded portion 26A inwardly of the bolt insertion hole 26 in the direction of diameter in parallel with the overlapping portion 23.

Figure 2:
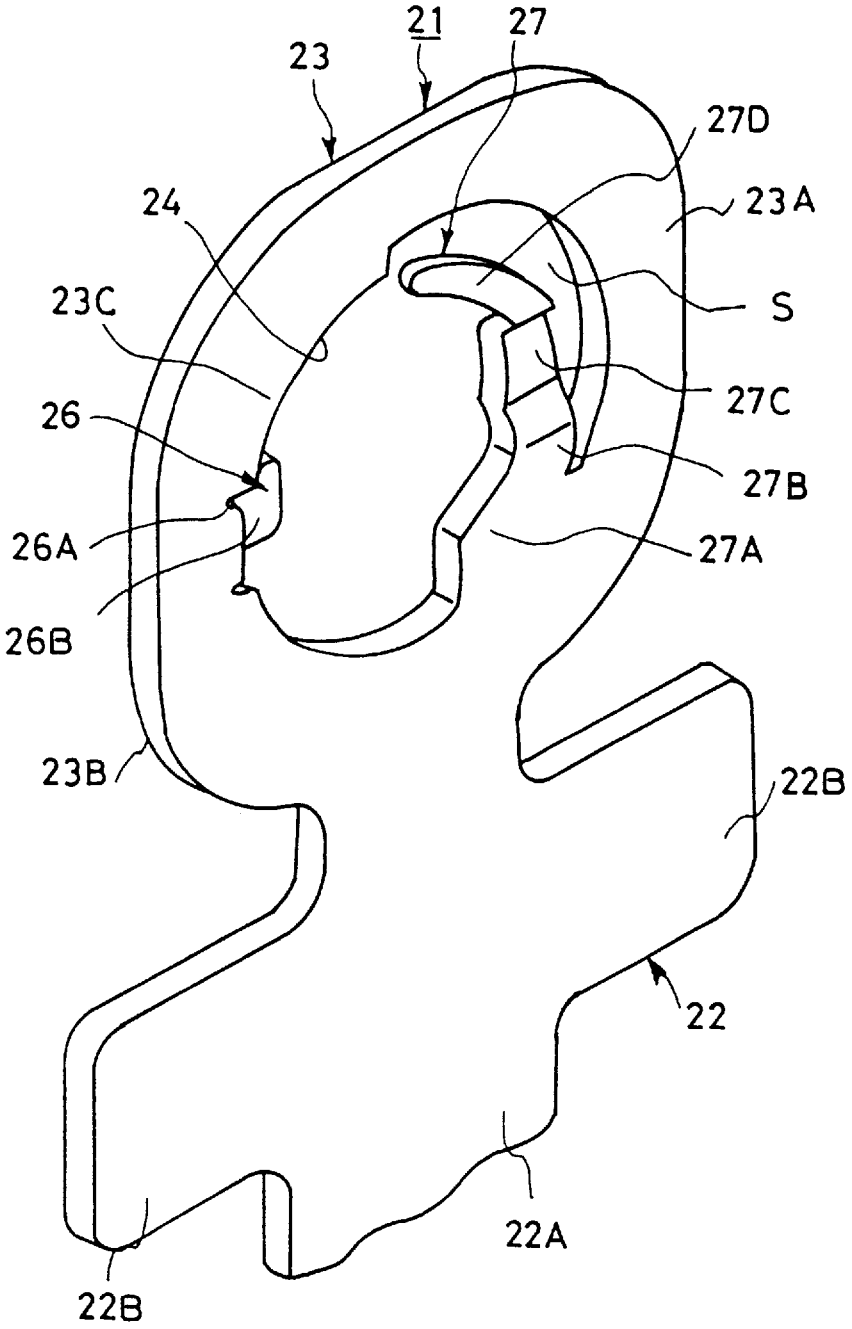
FIG. 2 is a perspective view illustrating an overlapping portion of the terminal body of FIG. 1 on an enlarged scale.
Figure 4:
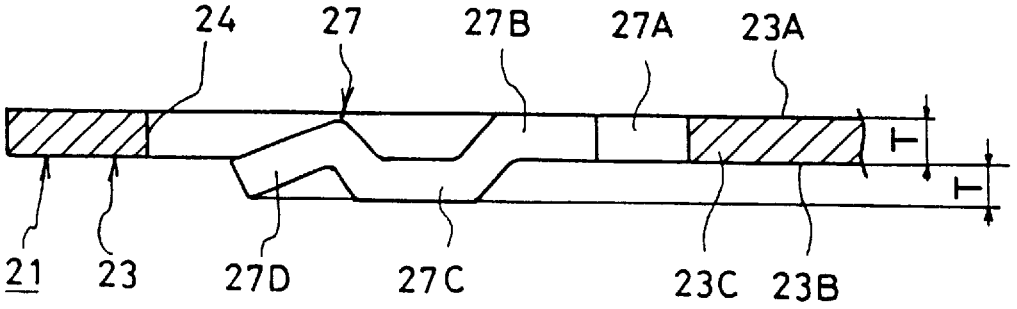
FIG. 4 is a sectional view illustrating the engaging pawl of the overlapping portion along the arrow IV—IV in FIG. 1.

Reference numeral 27 denotes the engaging piece which constitutes coupling means together with the engaging pawl 26. Referring to FIG. 2, the engaging piece 27 is formed like an arcuate piece smatter than 180 degrees on the side of the inner periphery 23C of the overlapping portion 23, which is on the other side of the bolt insertion hole 25 in the direction of diameter, and extends in the circumferential direction along the bolt insertion hole 25. Referring to FIG. 4, the engaging piece 27 is constituted by a support portion 27A which is formed on the side of the inner periphery 23C of the ovelapping portion 23 integrally therewith to serve as a fixed ends an arm portion 27B formed on the side of the end of the support portion 27A, a hook portion 27C which is fanned by folding the end of the arm portion 27B ready in a U-shape in cross section and on the inner side of which the engaging pawl 26 of the opposing terminal body is hooked, and a guide portion 27D which is formed as a free end becoming narrow toward the end thereof on the side of the end of the hook portion 27C and serving as a guide when the engaging pawl 26 of the opposing terminal body rides on the engaging piece 27.

Here, the hook portion 27C is formed to protrude toward the side of the back surface 23B of the overlapping portions 23 by an amount T, and the upper surface of the hook portion 27C is nearly in flush with the back surface 23B. The end or the free end of the guide portion 27C is protruded toward the side of the back surface 23B from inside the punched hole 24 by an amount equal to the thickness T.

A gap S, (see FIGS. 1 and 2) is formed in the circumferential direction between the inner periphery 23C of the overlapping portion 23 and the arm portion 27B, hook portion 27C, guide portion 27C of the engaging piece 27. Thus, for the engaging piece 27, the arm portion 27B on the side of the and, the hook portion 27C and the guide portion 27C undergo resilient deformation with the support portion 27A being as a fixed end.

The terminal for coupling the wirings according to the present embodiment is constituted as described above. Next, described below are the steps of assembling.

Figure 5:
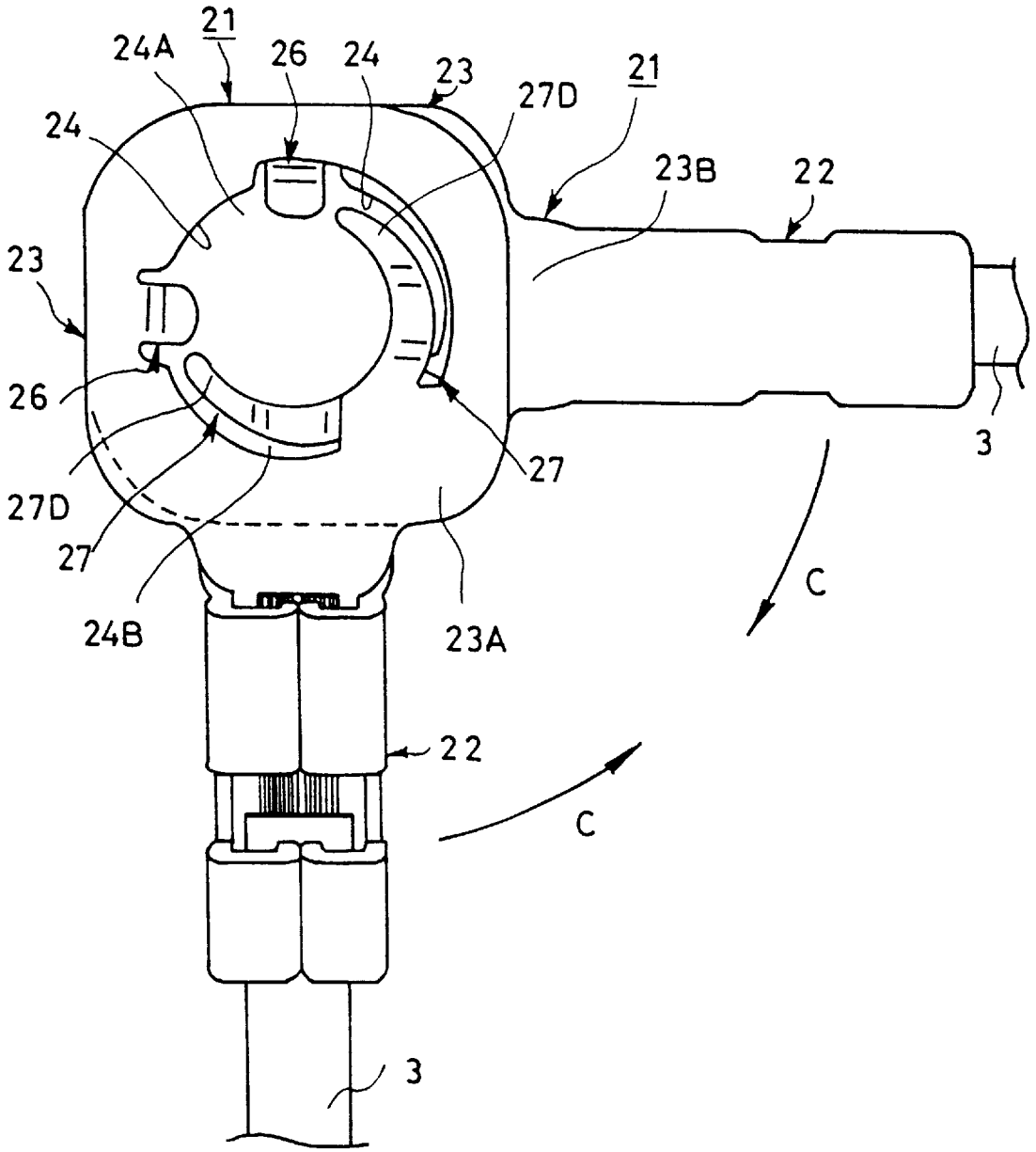
FIG. 5 is a diagram of appearance in a state where the overlapping portions of a pair of terminal bodies are overlapped one upon the other.

First, in connecting the wiring 3 to the terminal body 21, as shown in FIG. 5, the wiring 3 is secured by caulking onto the caulking seat portion 22A by using caulking portions 22B, 22C, and is connected to the side of the front surface 23A of the wiring connection portion 22.

Next, to couple the pair of terminal bodies 21, 21 together, the back surfaces 23B of the overlapping portions 23 are abutted together in a state of being brought to the positions of the bolt insertion holes 25 as shown in FIG. 5, Here, the wiring connection portions 22 are so arranged as to define an angle of about 90 degrees relative to each other, so that the engaging pawl 26 is disposed in the engaging pawl disposing portion 24A of the opposing terminal body, and the engaging piece 27 is disposed in the engaging piece disposing portion 24B of the opposing terminal body.

Figure 6:
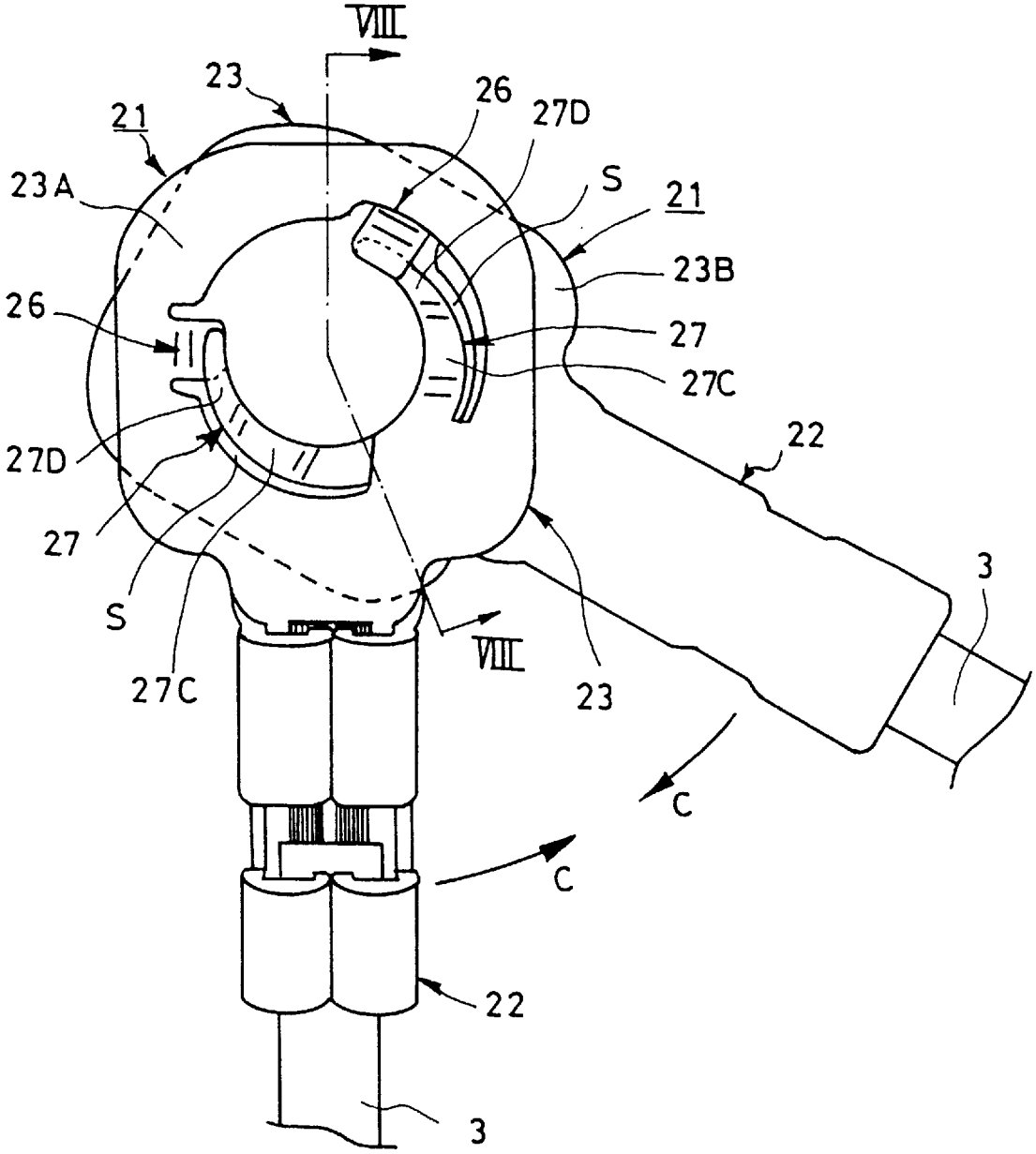
FIG. 6 is a diagram of appearance in a state where the terminal bodies of FIG. 5 are turned relative to each other, so that the engaging pawl rides on the engaging piece of the opposing terminal body.
Figure 8:
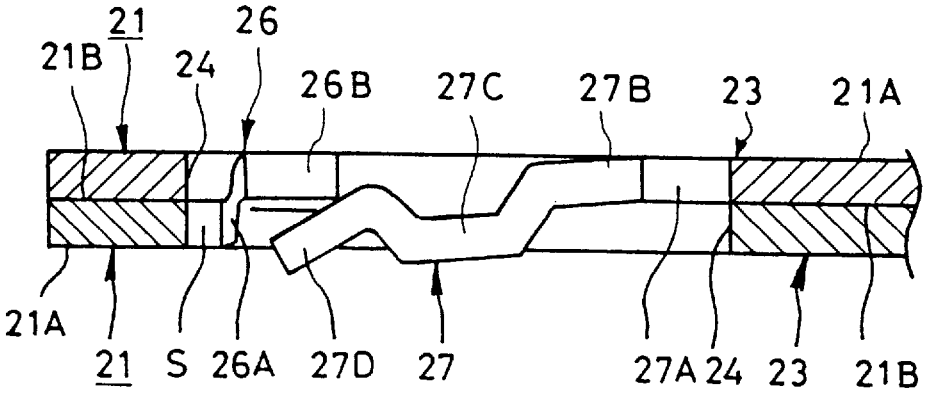
FIG. 8 is a sectional view along the arrow VIII—VIII in FIG. 6.

Then, the overlapping portions 23 of the terminal bodies 21 are turned relative to each other about the bolt insertion holes 25 in the directions of arrows C in FIG. 6. The engaging pawl 26 is abutted to the end of the engaging piece 27 (guide portion 27C) of the opposing terminal body, whereby the engaging piece 27 is pushed by the engaging piece 26 of the opposing terminal body as shown in FIG. 8 and is caused to undergo resilient deformation to protrude toward the side of the back surface 23B of the overlapping portion 23, and the engaging pawl 26 rides on the guide portion 27D of the opposing terminal body as shown in FIG. 6. Thus, the engaging pawls 26 are brought into engagement with the engaging pieces 27 of the opposing terminals through the gap S.

Figure 9:
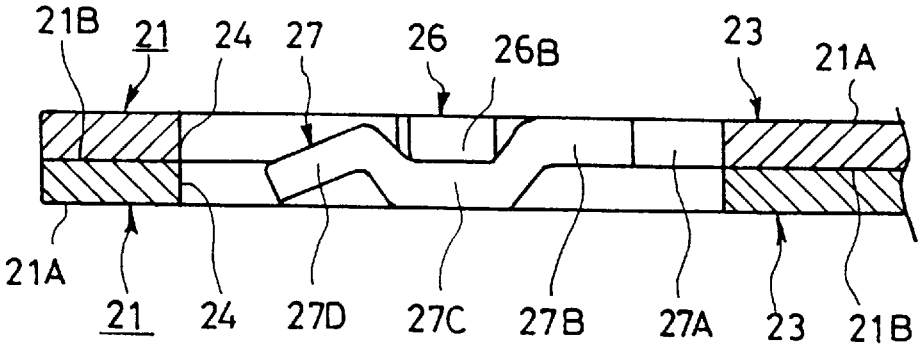
FIG. 9 is a sectional view along the arrow IX—IX in FIG. 7.

As the terminal bodies 21 are further turned in the direction of arrows C, the engaging pawl 26 slides on the engaging piece 27 of the opposing terminal body toward the hook portion 27C from the guide portion 27D. In a state where the terminal bodies 21 are turned relative to each other up to a position where the wiring connection portions 22 are overlapped one upon another as shown in FIG. 7, the pawl 26 is held in the hook portion 27C of the opposing terminal body as shown in FIG. 9, and is held in a hooked state in the hook portion 27C.

Figure 7:
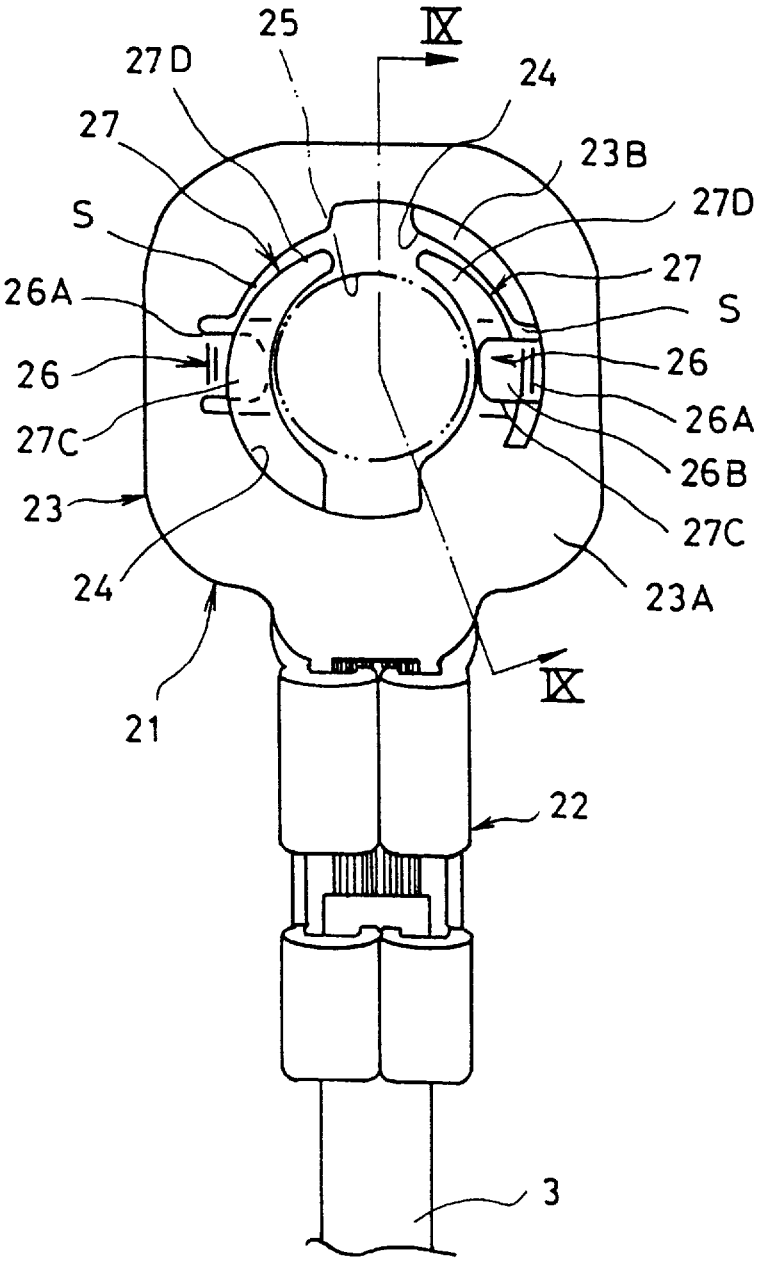
FIG. 7 is a diagram of appearance in a state where the terminal bodies of FIG. 6 are turned relative to each other, so that the engaging pawl is hooked to the hook portion of the engaging piece of opposing terminal body.

As a result, as shown in FIG. 7, the terminal bodies 21 are coupled together on one side and on the other side of the bolt insertion holes 25 in the direction of diameter via two sets of engaging pawls 26 and engaging pieces 27. In this state, the wiring connection portions 22 and the wirings 3 are overlapped one upon the other in a vertical direction in FIG. 7. In this state, the terminals 21 are attached to an external conductor (e.g., car body) by a bolt or the like, and the wirings 3 are connected (grounded) to the conductor.

According to this embodiment in which the terminal bodies 21 have an engaging pawl 26 and an engaging piece 27 as coupling means, the engaging pawl 26 reliably engages with the engaging piece 27 of the opposing terminal body through a very simple operation of turning a pair of terminal bodies 21 relative to each other, solving the problem in that the engaging/coupling operation is so complex that the pair of terminal bodies are not coupled together easily, correctly and reliably within short periods of time, that is inherent in the prior art. Thus, efficiency of the coupling/assembling operation is greatly enhanced.

With the terminal bodies 21 being coupled together, furthermore, the wiring connection portions 22 and the wirings 3 are overlapped one upon the other, making it possible to decrease the width between the wiring connection portions 22 and to decrease space compared with the case where the two coupling terminals are coupled together being arranged in a lateral direction as done in the conventional terminals for coupling the wirings. It is therefore allowed to easily lay out the terminal bodies 21 at the mounting positions on the external conductor, to enhance the efficiency of the mounting operation, and to greatly improve the operation efficiency for the insulation and anticorrosion treatment for the wiring connection portions 22.

Besides, the engaging pawl 26 is protruded inwardly of the bolt insertion hole 25 in the direction of diameter thereof on one side, and the engaging piece 27 is extended in the circumferential direction on the other side of the bolt insertion hole 25 in the direction of diameter thereof. When the terminal bodies 21 are turned relative to each other being overlapped one upon the other at their overlapping portions 23, therefore, the engaging pawl 26 easily engages with the engaging piece 27 of the opposing terminal body from the side of the end thereof. Thus, the terminal bodies 21 can be correctly coupled together through a further simplified operation, making it possible to further increase the efficiency of the coupling operation. Moreover, the terminal bodies can be easily press-molded without increasing the number of the production steps of the cost of production. Provision of the guide portion 27D makes it possible to further improve the efficiency of the coupling operation.

In a state where the hook portion 27C is formed in the engaging piece 27, and the terminal bodies 21 are coupled together, the engaging pawl 26 is held being hooked in the hook portion 27C of the opposing terminal body. Therefore, the terminal bodies 21 can be reliably coupled together owing to the engaging pawl 26 and the hook portions 27C, and can be stably attached to the external conductor.

In the above-mentioned embodiment, the engaging piece 27 is elongated in the circumferential direction toward the end side from the base end side (from the side of the wiring connection portion 22) of the overlapping portion 23. Not being limited thereto according to the present invention, however, the engaging piece 27 may be extended from the end side to the base end side of the overlapping portion 23. Moreover, the engaging pawl 26 and the engaging piece 27 were arranged on the left and right sides of the bolt insertion hole 25 in FIG. 1, The engaging pawl 26 and the engaging piece 27, however, may be arranged on the upper and lower sides of the bolt insertion hole 25.

In the above-mentioned embodiment, the engaging pawl 26 and the engaging piece 27 are detachably engaged together. They, however, can be so constituted as will not be easily separated away from each other after they are once engaged with each other unless the engaging pawl 26 or the engaging piece 27 is elastically deformed or is destroyed. This can be accomplished, for example, by forming the edge line connecting the hook portion 27C of the side in which the engaging pawl 26 is inserted to the guide portion 27D in a manner upwardly directed nearly perpendicularly in FIG. 4, or by forming the engaging piece 27 (i.e., terminal body) using a member having a large modulus of elasticity, or by using a relatively thick material, instead of forming the edge line connecting the hook portion 27C of the side in which the engaging pawl 26 is inserted to the guide portion 27C in a nearly arcuate smooth shape.

In the above-mentioned embodiment, furthermore, the guide portion 27D is provided on the side of the engaging piece 27. Not being limited thereto, however, the corner of the engaging pawl 26 may be chamfered so as to be easily engaged with the engaging piece 27. Then, the chamfered portion works as a guide portion. Besides, both the engaging pawl 26 and the engaging piece 27 may be provided with a guide portion (guide portion 27D or chamfered portion).

In the above-mentioned embodiment, hook portion 27C was formed by forming the engaging place 27 in a recessed shape. Not being limited thereto only, however, a protruded portion (or a recessed portion) may be formed in the engaging surface of the engaging pawl 26, a recessed portion (or a protruded portion) may be formed on the engaging surface of the engaging piece 27, and the protruded portion and the recessed portion may be engaged together to inhibit (hook) the engaging pawl 26 and the engaging piece 27 from moving relative to each other. Moreover, a plurality of recessed shapes and protruded shapes may be formed in the engaging surfaces of the engaging pawl 26 and the engaging piece 27, and the plurality of recessed shapes and protruded shapes may be engaged together to inhibit (hook) the engaging pawl 26 and the engaging piece 27 from moving relative to each other.

As described above, the terminal for coupling the wirings of the present invention is simply constructed, features good coupling/assembling operability, needs decreased space, and offers great industrial applicability,

What we claimed are:

1. A terminal for coupling wirings comprising:

a pair of terminal bodies, each having:

a wiring connection portion and an overlapping portion with a bolt insertion hole, and coupling means provided on the overlapping portions of said terminal bodies to hold said terminal bodies in a state of being coupled together;

wherein each said coupling means includes:

an engaging pawl which is formed so as to protrude radially inwardly into said bolt insertion hole and which is positioned on a first side of said bolt insertion hole, and an engaging piece which is formed so as to protrude radially inwardly into said bolt insertion hole in a resiliently deformable manner and which is positioned radially opposite said engaging pawl; and wherein said overlapping portions of said pair of terminal bodies are each overlapped one upon the other in a manner to be positioned on the opposing bolt insertion hole, respectively, while avoiding interference between either of the engaging pawls and the engaging piece, and then are turned relative to each other in the direction of the diameter of each of said bolt insertion holes, so that the engaging piece of one of the terminal bodies rises on a side of an unoverlapped face of the engaging pawl of the other terminal body while resiliently deforming, and that the engaging bawls and engaging pieces of said pair of terminal bodies are engaged mutually, to thereby couple said pair of terminal bodies together.

2. A terminal for coupling wirings according to claim 1, wherein said engaging piece is constituted to be detachably brought into engagement with said engaging pawl.

3. A terminal for coupling wirings according to claim 1, wherein said engaging piece extends arcuately in the circumferential direction of said bolt insertion hole so that an end thereof which is a free end, rides on said engaging pawl of the other terminal body.

4. A terminal for coupling wirings according to claim 1, wherein both the engaging piece and the engaging pawl, or either the engaging piece or the engaging pawl include a guide portion for guiding engagement of the engaging pawl and the engaging piece.

5. A terminal for coupling wirings according to claim 1, wherein the engaging piece or both the engaging piece and the engaging pawl include a hook portion for holding the engaging pawl and the engaging piece in a hooked state.

6. A terminal for coupling wirings comprising:

a pair of terminal bodies, each having:

a wiring connection portion, a bolt insertion hole, and coupling means for coupling said terminal bodies together, each said coupling means including:

an engaging pawl which is formed so as to protrude radially inwardly into the bolt insertion hole, and an engaging piece which is formed so as to protrude radially inwardly into said bolt insertion hole at a position radially opposite the engaging pawl.

7. A terminal for coupling wirings according to claim 6, wherein the engaging pawl of each terminal body is resiliently deformable upon engagement with the engaging piece of the other terminal body.

8. A terminal body for coupling wirings according to claim 6, wherein each of the terminal bodies are symmetrically shaped and arranged so that, when placed flat against one another at a predetermined angle with respect to one another, relative rotation therebetween induces engagement wherein the engaging piece of one terminal body engages the engaging pawl of the other terminal body.

* * * * *